US008125414B2

(12) United States Patent
Hunter et al.

(10) Patent No.: US 8,125,414 B2
(45) Date of Patent: Feb. 28, 2012

(54) ELECTROLUMINESCENT DISPLAY DEVICE

(75) Inventors: Iain M. Hunter, Brighton (GB); Mark T. Johnson, Veldhoven (NL); Mark J. Childs, Sutton (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 2134 days.

(21) Appl. No.: 10/302,353

(22) Filed: Nov. 22, 2002

(65) Prior Publication Data

US 2003/0098828 A1 May 29, 2003

(30) Foreign Application Priority Data

Nov. 28, 2001 (GB) ..... 0128419.9

(51) Int. Cl.
*G09G 3/30* (2006.01)

(52) U.S. Cl. ..... 345/76; 345/77; 345/82; 345/205; 345/211; 345/690

(58) Field of Classification Search ..... 345/76–77, 345/82, 205, 211, 213, 690, 694
See application file for complete search history.

(56) References Cited

U.S. PATENT DOCUMENTS

| | | | | |
|---|---|---|---|---|
| 4,032,818 | A * | 6/1977 | Chan | 315/169.2 |
| 5,793,985 | A * | 8/1998 | Natarajan et al. | 709/247 |
| 5,874,933 | A | 2/1999 | Hirai et al. | |
| 6,023,259 | A | 2/2000 | Howard et al. | 345/76 |
| 6,137,466 | A | 10/2000 | Moughanni et al. | |
| 6,501,523 | B2 * | 12/2002 | Hirota et al. | 349/117 |
| 6,734,636 | B2 * | 5/2004 | Sanford et al. | 315/169.3 |
| 6,765,549 | B1 * | 7/2004 | Yamazaki et al. | 345/80 |
| 2002/0033783 | A1 * | 3/2002 | Koyama | 345/82 |
| 2002/0036627 | A1 * | 3/2002 | Yokoyama | 345/204 |
| 2002/0060674 | A1 * | 5/2002 | Tsutsui et al. | 345/204 |

FOREIGN PATENT DOCUMENTS

| | | | |
|---|---|---|---|
| EP | 0717446 | | 6/1996 |
| JP | 60064395 | A | 4/1985 |
| JP | 11085100 | A | 3/1999 |
| JP | 2001042831 | A | 2/2001 |
| JP | 2001290642 | A | 10/2001 |
| WO | WO9636959 | | 11/1996 |
| WO | WO9942983 | | 8/1999 |
| WO | 0148731 | A1 | 7/2001 |

* cited by examiner

*Primary Examiner* — Richard Hjerpe
*Assistant Examiner* — Leonid Shapiro

(57) ABSTRACT

An EL display device is operable in analogue and digital modes. In the analogue mode a current is supplied to the EL display elements (2) in dependence on a data signal (6) supplied to the pixel, and in the digital mode one of two voltages is provided across the EL display elements in dependence on the data signal supplied to the pixel. This enables the display to have a low power standby mode in which a digital drive scheme is implemented. This is particularly appropriate for static images and preferably for images without grey scales. The first mode is the normal current addressing mode.

24 Claims, 3 Drawing Sheets

ELECTROLUMINESCENT DISPLAY DEVICE

The invention relates to electroluminescent display devices, for example using organic LED devices such as polymer LEDs.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase. However, different transistor characteristics across the substrate give rise to different relationships between the gate voltage and the source-drain current, and artefacts in the displayed image result.

Digital drive schemes have also been proposed. In such schemes, the LED device is effectively driven to two possible voltage levels. This reduces the power consumption in the pixel circuit, because a transistor is no longer required to operate in the linear region as a current source. Instead, all transistors can be fully on or fully off, which reduces power consumption. Such a drive scheme is less sensitive to transistor characteristic variations for the same reason. This approach only gives two possible pixel outputs. However, grey scale pixel outputs can be achieved by a number of methods.

In one approach, pixels can be grouped to form larger pixels. Pixels within the group can be addressed independently, so that a grey scale is produced which is a function of the number of pixels within the group activated. A drawback of this approach is the reduced resolution of the display and the increased pixel complexity.

In an alternative approach, pixels can be turned on and off more quickly than the frame rate, so that a grey scale is implemented as function of the duty cycle with which the pixel is turned on. This increases the required driving capability, and therefore increases the cost of the display.

As digital drive schemes are essentially voltage based drive schemes, the pixel output is particularly sensitive to non-uniformity in the LED devices. In particular, device degradation will lead to a burn-in of images as the current (and therefore light output) of degraded pixels drops rapidly in a fixed voltage drive scheme. If a part of a pixel is not emitting light (so-called black spots), a constant voltage drive scheme will also give rise to dimmer output for the pixel, because the current density is reduced. In current driven pixels, the constant current results in an increase in current density so that total light output from a pixel is almost independent of black spots.

According to a first aspect of the invention, there is provided an electroluminescent (EL) display device comprising an array of display pixels, each display pixel comprising an EL display element and a driving circuit, wherein each pixel is operable in first and second modes, wherein in the first mode an analogue current is supplied to the EL display element by the driving circuit in dependence on a data signal supplied to the pixel and in the second mode one of two voltages is provided across the EL display element by the driving circuit in dependence on the data signal supplied to the pixel.

This pixel configuration enables a pixel to be operated in a digital or analogue drive mode. This enables the display to have a low power standby mode (the second mode) in which a digital drive scheme is implemented. This is particularly appropriate for static images and preferably for images without grey scales. The first mode is the normal current addressing mode.

The driving circuit may comprise a current source section for supplying current to the EL display element, wherein in the first mode the current source section is supplied by a first voltage and supplies the analogue current to the EL display element and in the second mode the current source section is supplied by a second voltage and drives the EL display element to one of two states.

A current source pixel section is thus used for supplying the drive signal to the EL pixel, but in different modes of operation, the current source section is operated differently.

The current source section of each driving circuit may comprise a transistor connected between a supply voltage line and the EL element and wherein the gate voltage on the transistor is controlled in dependence on the data signal. This enables the conventional analogue drive scheme to be implemented.

A first voltage may be provided by the supply voltage line in the first mode of operation, and a second voltage may be provided by the supply voltage line in the second mode of operation. In the first mode, there is a relatively high voltage drop across the current source transistor, and a high supply voltage is required. In the second mode, there is a lower voltage drop across the transistor, because it is turned on much harder in the digital mode, so that a lower supply voltage is appropriate.

Thus, the first voltage and the range of levels of the data signal in the first mode are selected such that the transistor is operable in the linear region, such that the current provided by the current source is a function of the data signal. The second voltage and the data signal levels in the second mode are selected such that the transistor is fully turned on or turned off, such that a fixed voltage dependent on the second voltage is supplied to or isolated from the EL element.

Each pixel preferably comprises a single voltage supply line, and switching means is provided for selecting the voltage on the voltage supply line. This requires circuitry for controlling the voltage applied to the supply line.

Alternatively, each pixel may comprise two voltage supply lines, and wherein a mode switching arrangement is provided for selecting which voltage supply line signal is used to supply the current source transistor. This mode switching arrangement can be provided for a group of pixels.

The device may further comprise means for applying a mode select to enable the mode to be selected for a pixel being addressed. This means may apply a signal to a region of the display, based on a measure of the amount of movement within the image for that region of the display.

The display may be used in a portable electronic device, such as a mobile telephone.

The invention also provides a method of driving an electroluminescent (EL) display device comprising an array of pixels, each pixel comprising an electroluminescent (EL) display element and a drive circuit, the method comprising, for each pixel of the display:

selecting an analogue or a digital drive mode;

when the analogue mode is selected, supplying a data signal to the pixel thereby resulting in an analogue current being supplied to the EL display element;

when the digital mode is selected, supplying a data signal to the pixel thereby driving the EL display element to one of two states.

This method enables pixels to be driven in analogue or digital modes.

The driver circuit may comprise a current source section for supplying current to the EL display element, and wherein in the first mode the current source section is supplied using a first voltage and in the second mode the current source section of the pixel is supplied using second voltage.

All pixels of the display may be in one mode within any frame period, or else the display may be split into regions. The digital drive mode may be selected for the display of static images and the analogue drive mode may be selected for the display of moving images.

Embodiments of display devices in accordance with the invention will now be described, by way of example, with reference to the accompanying drawings, in which.

Figure 1:
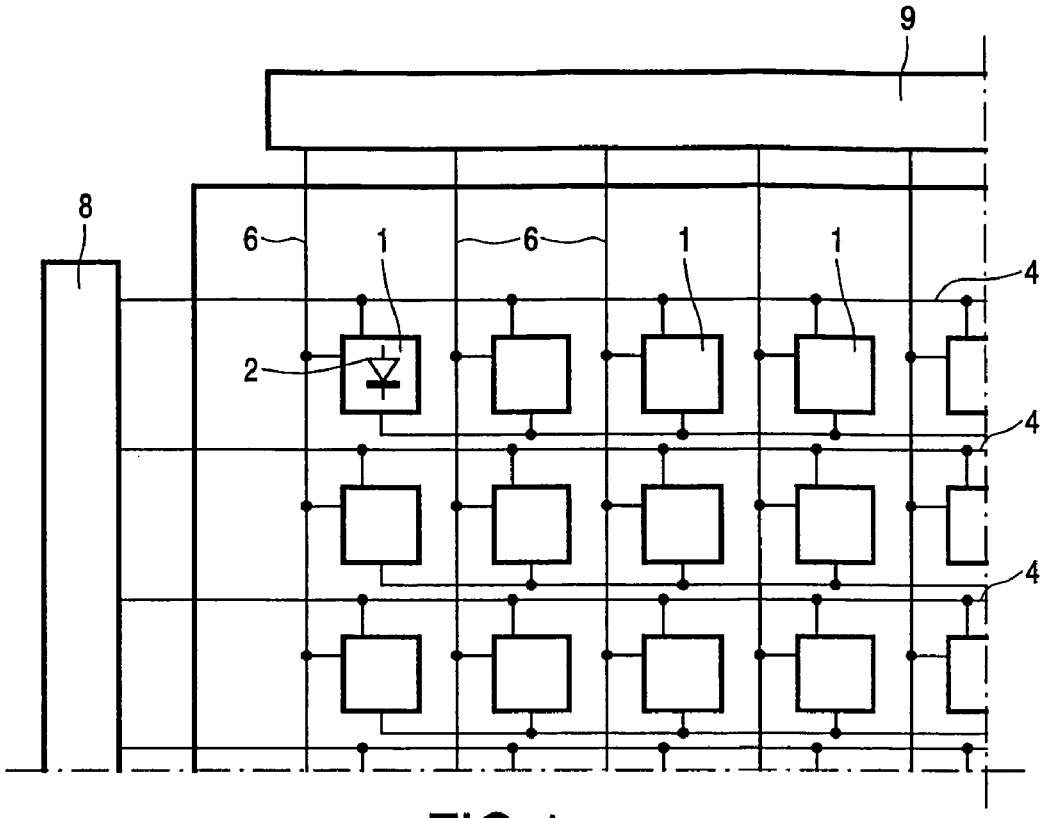
FIG. 1 shows an EL display device according to the invention.

Referring to FIG. 1, an active matrix addressed electroluminescent display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

Figure 2:
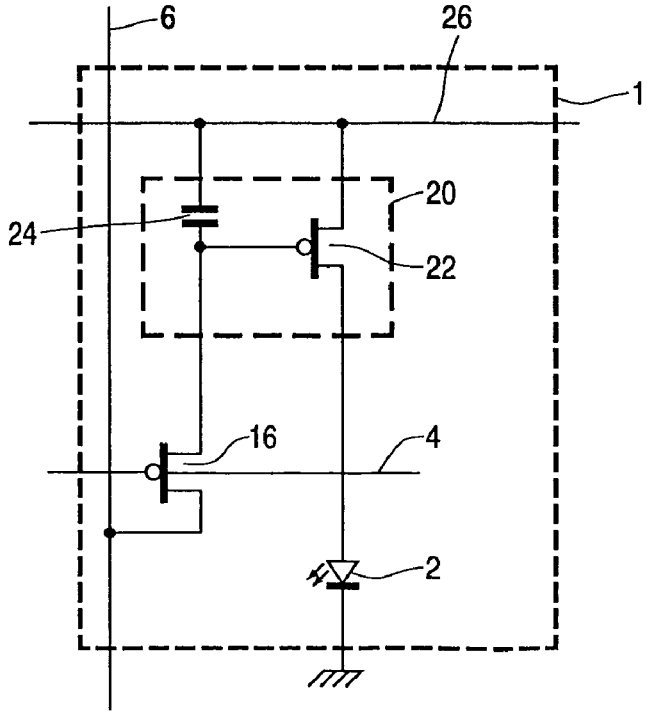
FIG. 2 is a simplified schematic diagram of a pixel circuit for current-addressing an EL display pixel.

FIG. 2 shows in simplified schematic form the pixel and drive circuitry of a first example of the invention. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

In accordance with the invention, this pixel configuration is operable in first and second modes.

In a first, analogue mode, the range of the gate voltages on the drive transistor 22 in combination with the voltage on the power rail 26 supplying the current source 20 are selected such that the transistor is operating in the linear region, so that the source-drain current is approximately linearly proportional to the gate voltage. Thus, the voltage on the column conductor 6 is used to select a desired current flow to the display element 2. In this mode, typically around 6V will be dropped across the source-drain of the drive transistor 22, and as a result, the voltage on the power rail 26 will need to be around 10V so that a required voltage drop across the LED of around 4V is achieved (when the cathode is grounded as shown). Typical gate voltages will be in a range with a stored voltage on the storage capacitor 24 of around 4V. For example, the data signal on the column conductor 6 may fall within a range of around 5-7V.

In a second, digital mode, the possible gate voltages on the drive transistor 22 in combination with the voltage on the power rail 26 supplying the current source 20 are selected such that the transistor is fully turned on or off. When fully turned on, there is almost no voltage drop across the drive transistor 22, and the voltage on the supply rail 26 is effectively provided on the display element 2. The voltage on the column conductor 6 is used to select one of two possible drive voltages for the display element 2. In this mode, the voltage on the power rail 26 needs to be around 4V, and the drive transistor is addressed to be fully on or fully off, for example by selecting gate voltages of either 0V or 10V across the capacitor.

Figure 3:
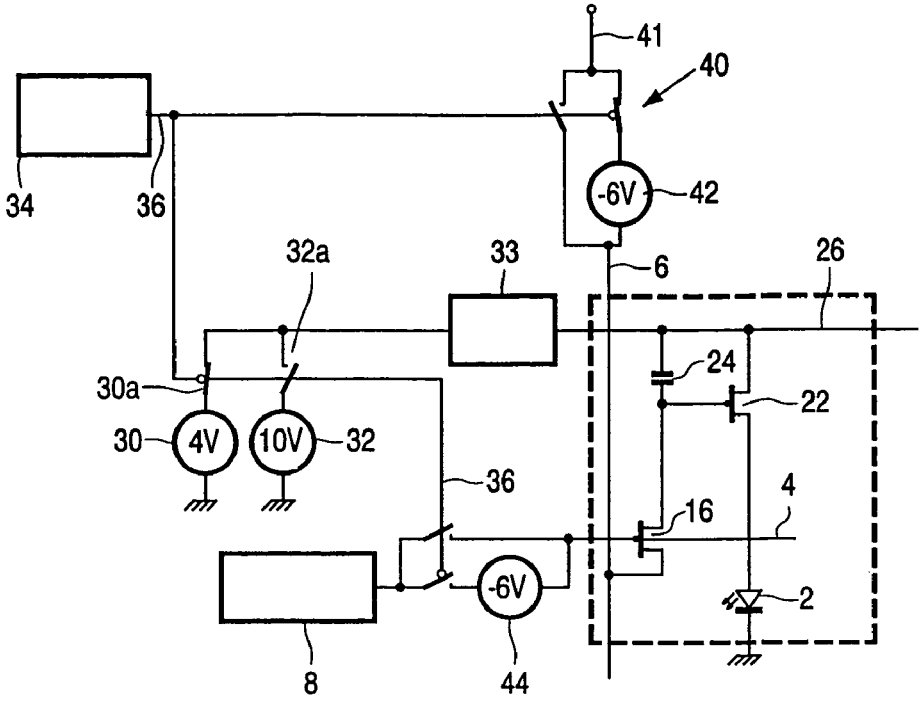
FIG. 3 shows a first example of pixel circuit and associated drive circuitry according to the invention.

FIG. 3 shows one possible implementation of the peripheral circuitry to obtain the operation described above.

In order to enable the power rail 26 to be provided with two possible voltages, first and second power supplies 30,32 are provided, with one being coupled to the power rail through an associated switch 30*a*,32*a* dependent on the mode selected. A drive circuit 33 drives the power rail. A mode selection device 34 provides an output 36 dictating which mode is selected, and this output 36 controls the switches 30*a*,32*a*. The use of two separate power sources 30,32 minimises power consumption.

The data signal is provided on the column conductor 6 through an adjustment circuit 40. In the analogue mode, the adjustment circuit simply couples a data input 41 to the column 6. In the digital mode, different gate voltages are required on the gate of the drive transistor 22, and this may be achieved by scaling the data signal, for example by lowering the voltage by 6V using a series voltage source 42 as shown. The mode selection output 36 determines whether or not the voltage scaling is applied or not. The data signal provided can then be in the same range of values as for the analogue scheme so that the same column drivers can be used. However, only two possible data signal values are provided one to fully turn on the drive transistor and one to fully turn it off.

In view of the change to the column voltage in the digital mode, a different voltage is required to turn on the address transistor 16 sufficiently to allow the passage of charge sufficiently rapidly into the storage capacitor 24. For this reason, a series voltage source 44 is switched between the output of the row address circuitry 8 and the row conductor 4 for the digital mode. Again, this is under the control of the mode selection output 36.

The invention enables the display to have a low power digital standby mode and a higher quality analogue mode. The digital mode is particularly suitable for static images and preferably for images with only two grey scale values. The use of the digital mode during standby gives significant overall power savings, which is particularly important for portable battery operated devices, such as mobile telephones. The analogue mode provides full grey scale performance, and is less susceptible to black spot artifacts. In addition, any burn-in experienced in the digital mode (where addressed pixels degrade thereby changing their light output characteristics) will be less visible in the analogue current-addressing mode.

Whilst the simplest implementation of the invention is to allow only two-level grey scale addressing of pixels in the digital mode, it is equally possible to provide multiple grey scale performance in the digital mode, using any of the conventional techniques, such as time-ratio addressing or sub-pixellation as discussed above. High update frequencies are not likely to be required in the standby mode, so that the time-ratio method could easily be implemented.

When the digital mode operates in a two-level scheme, the burn-in of all addressed pixels will be the same. If the same image is always used for the standby mode, this will result in a known group of pixels suffering equal burn-in deterioration. This lends itself to a compensation scheme in the analogue drive mode, for example in which those pixels are overdriven in the analogue mode. The degree of overdriving required could be estimated from the standby time or else could be evaluated by monitoring pixel voltage levels of an additional test pixel provided specifically for this purpose.

Figure 4:
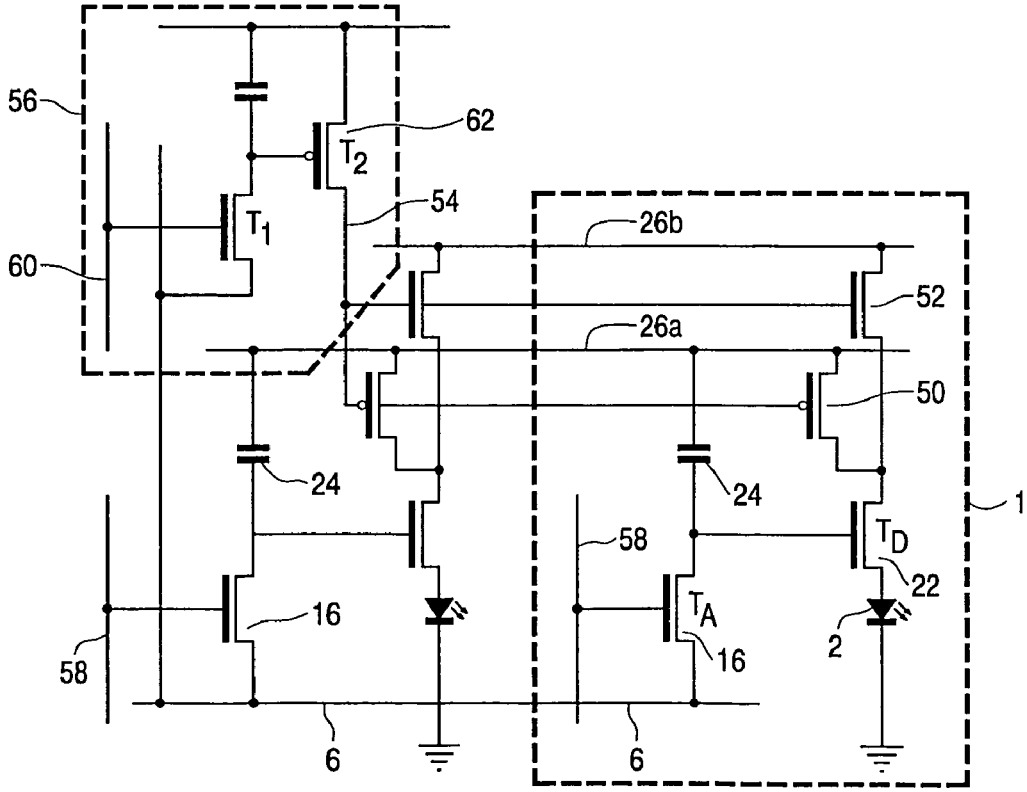
FIG. 4 shows a second example of pixel circuit and associated drive circuitry according to the invention.

In the example of FIG. 3, each pixel comprises a single voltage supply line, and the desired voltage is switched on to the voltage supply line from one of two voltage sources. FIG. 4 shows an alternative configuration in which each pixel comprises two voltage supply lines, and wherein a mode switching arrangement is provided for selecting which voltage supply line signal is used to supply the current source transistor. FIG. 4 is also used to explain a system in which switching between modes is based on image movement. These changes should, however, be understood to be independent.

In FIG. 4, there are two separate power rails 26*a*, 26*b* supplying each pixel. Each pixel 1 again comprises an address transistor 16 to which the data signal is provided on a conductor 6 (in this example extending in the row direction), and this data signal is coupled by the address transistor 16 to the gate of the drive transistor 22. The first power rail 26*a* is coupled to the storage capacitor 24, and is coupled to the drive transistor 22 through a first switching transistor 50. When the switching transistor 50 is turned on the pixel operates in the same way as the pixel in FIGS. 2 and 3, and this provides the analogue mode of operation. Thus, the first power rail 26*a* carries the required analogue voltage level, for example 10 Volts.

The second power rail 26*b* is coupled to the drive transistor 22 through a second switching transistor 52. The required digital supply voltage is provided on the second power rail 26*b*, for example 4 Volts.

The first and second switching transistors 50, 52 are controlled by a single mode selection signal 54, and the transistors 50, 52 are of opposite type so that one is turned on and the other is turned off at any one time. Thus, the mode selection line 54 dictates which power rail 26*a*, 26*b* is to supply the pixel 1 and thereby dictate the mode of operation.

The mode selection signal 54 is provided by a switching block 56, and this switching block 56 provides a mode selection signal 54 for a group of pixels.

In the example of FIG. 4, the addressing signals are shown as provided on column conductors 58, but these are again for applying a suitable gate voltage to the addressing transistors 16 within the pixels. In addition, the switching block 56 has an addressing line 60, and this enables a signal from the conductor 6 (the video data line) to be provided to the switching block 56. Two possible signals are provided to the switching block 56 resulting in different gate voltages on the current source transistor 62. The two possible output signals from the switching block 56 result in one or other of the power rails 26*a*, 26*b* being selected. It will be seen that the structure of the switching block 56 is similar to the structure of a pixel and is used simply to provide two possible outputs which can be used for switching the switching transistors 50, 52.

As described in connection with FIG. 3, in the digital mode the video data line 6 is used to provide a digital on or off voltage, whereas in the analogue mode the video line 6 provides an analogue brightness signal.

In the example shown in FIG. 4, a single switching block 56 is associated with two pixels. In fact, the display may be divided into any number of groups of associated pixels which can be controlled as an independent block. Thus, rather than simply switching across the whole display between digital and analogue modes, the screen is broken down into areas, and the amount of movement of the image within each area can be used to determine the most appropriate driving scheme for each area.

The MPEG system divides images into blocks and has a structure which determines amount of movement within blocks. This information can be used to determine whether an area of the screen should be driven in the digital or in the analogue mode. The circuit of FIG. 4 allows each block of pixels to select which power line is to be used, whereas this is of course not possible using the circuit of FIG. 3.

An alternative is to divide the frame period into two halves. This would then allow a single power supply line to be used as in FIG. 3, but would still allow the mode of operation to be selected independently for different areas of the display. During a first half of the frame period, the power rail would be set to the digital state and the selected pixels would be addressed. During the second half of the frame period the power rail would be set to the analogue state and the remaining pixels would then be addressed.

Figure 5:
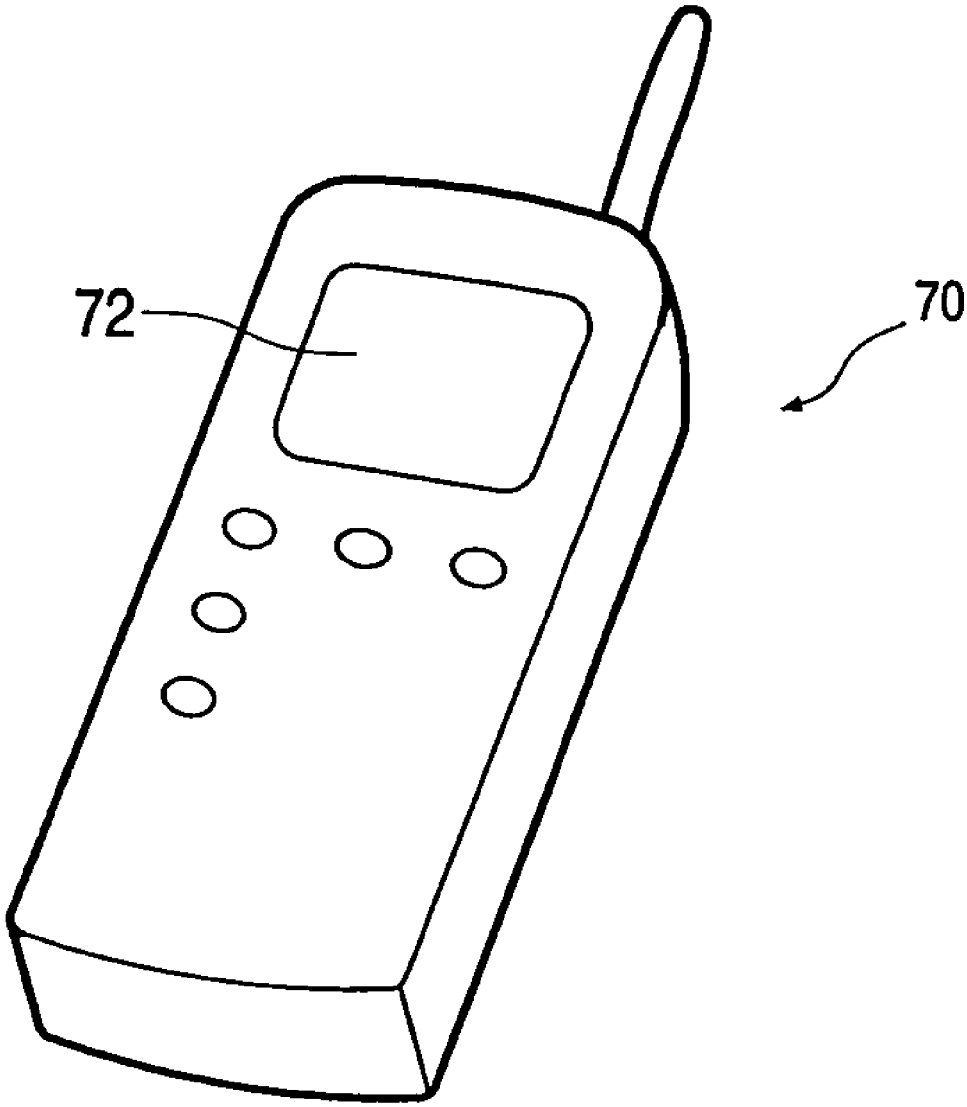
FIG. 5 shows a portable device with a display of the invention.

As discussed above, the invention is particularly suitable for low power displays and FIG. 5 shows a mobile telephone 70 incorporating a display 72 of the invention.

The pixel circuits described above are only examples of possible pixel structures in which a current source is controlled by a data signal to provide a variable current to the LED element. Other possible pixel configurations will be known to those skilled in the art, and the invention can provide benefits in many different such configurations.

From reading the present disclosure, other modifications will be apparent to persons skilled in the art. Such modifications may involve other features which are already known in the field of matrix electroluminescent displays and component parts thereof and which may be used instead of or in addition to features already described herein.

The digital mode has been described as having benefits in reducing power consumption. Other measures may additionally be employed, for example dimming the display or operating in a pulsed mode for standby. Approaches such as these may supplement the digital drive scheme.

The invention claimed is:

1. An electroluminescent (EL) display device comprising
an array of display pixels,
each display pixel comprising
an EL display element and
a driving circuit that is configured to drive the EL display element based on a data signal and a supply voltage and
a mode controller that is configured to control the supply voltage to each display pixel,
wherein:
each pixel is operable in first and second modes, wherein:
in the first mode, the mode controller is configured to provide a first value of the supply voltage to place a driving transistor in the driving circuit in a linear mode, so that an analogue current is supplied to the EL display element by the driving circuit in dependence on the data signal supplied to the pixel, and
in the second mode, to provide a second value of the supply voltage to place the driving transistor in a switching mode, so that one of two voltages is provided across the EL display element by the driving circuit in dependence on the data signal supplied to the pixel;
the first value of the supply voltage is configured to provide a first voltage drop across the driving transistor;
the second value of the supply voltage is configured to provide a second voltage drop across the driving transistor; and
the second voltage drop is substantially less than the first voltage drop.

2. The device of claim 1, wherein
the driving transistor is connected between the supply voltage and the EL element, and a gate voltage on the driving transistor is controlled in dependence on the data signal.

3. The device of claim 1, wherein
each pixel comprises a single voltage supply line, and
the mode controller is configured to selectively apply one of the first value and the second value to the voltage supply line.

4. The device of claim 1, wherein
each pixel comprises two voltage supply lines, and
the mode controller is configured to control which voltage supply line signal is used to supply the driving transistor.

5. The device of claim 4, wherein
the mode controller includes a plurality of mode switching arrangements, wherein each mode switching arrangement is provided for a group of pixels.

6. The device of claim 5, wherein
each voltage supply line is coupled to the driving transistor through a respective coupling transistor, and wherein
the mode switching arrangement selectively provides
a first output for switching a first coupling transistor on and a second coupling transistor off, or
a second output for switching the first coupling transistor off and the second coupling transistor on.

7. The device of claim 1, wherein
each EL display element comprises a polymer light emitting diode.

8. The device of claim 1, wherein
the pixels are arranged in rows and columns, and
the data signal is provided on column conductors.

9. The device of claim 8, wherein
each row of pixels shares a row conductor for communicating a row voltage, and
each pixel comprises an address transistor, coupled between the column conductor and the driving circuit, that is controlled by the row voltage.

10. The device of claim 1, wherein the mode controller is configured to enable the mode to be selected for one or more pixels being addressed.

11. The device of claim 10, wherein
the display pixels are partitioned into regions, and
the mode controller is configured to selective the mode of each region, based on a measure of the amount of movement within an image displayed in the region.

12. A portable electronic device comprising a display device as claimed in claim 1.

13. The device of claim 1, wherein
each pixel is addressed by a row signal,
the mode controller is configured to control the row signal, such that, in the first mode, a first row signal value is applied to the row signal, and in the second mode, a second row signal value is applied to the row signal, and
the second row signal value is substantially less than the first row signal value.

14. The device of claim 1, wherein
a column driver provides a data input signal, and
the mode controller is configured to control the data signal, such that, in the first mode, the data signal substantially equals the data input signal, and in the second mode, the mode controller applies a voltage offset to the data input signal to form the data signal.

15. A method of driving an electroluminescent (EL) display device comprising an array of pixels, each pixel comprising an electroluminescent (EL) display element and a drive circuit, the method comprising, for each pixel of the display:
selecting an analogue or a digital drive mode;
when the analogue mode is selected,
providing a first set of voltages to the drive circuit to place the drive circuit in a linear mode, and
supplying a data signal to the pixel thereby resulting in an analogue current being supplied to the EL display element;
when the digital mode is selected,
providing a second set of voltages to the drive circuit to place the drive circuit in a switching mode, and
supplying a data signal to the pixel thereby driving the EL display element to one of two states,
wherein
the first set of voltages are configured to provide a first voltage drop across a driving element of the drive circuit,
the second set of voltages are configured to provide a second voltage drop across the driving element, and
the second voltage drop is substantially less than the first voltage drop.

16. The method of claim 15, wherein the driver circuit includes a current source section for supplying current to the EL display element, and wherein in the first mode the current source section is supplied using a first supply voltage value of the first set of voltages, and in the second mode the current source section of the pixel is supplied using a second supply voltage value of the second set of voltages.

17. The method of claim 16, wherein within a frame period, the digital and analogue drive modes are selected independently for different regions of the display device.

18. The method of claim 17, wherein the drive mode for each region of the display device is selected in dependence on an amount of previous image movement within the region.

19. The method of claim 15, wherein the analogue or the digital drive mode is selected for all pixels of the display device within any frame period.

20. The method of claim 19, wherein the drive mode is selected in dependence on one or more requirements of the display device.

21. The method of claim 19, wherein the digital drive mode is selected for displaying static images and the analogue drive mode is selected for displaying moving images.

22. The method of claim 15, wherein within a frame period, the digital and analogue drive modes are selected independently for different regions of the display device.

23. The method of claim 22, wherein the drive mode for each region of the display device is selected in dependence on an amount of previous image movement within the region.

24. The method of claim 23, wherein the amount of previous image movement is derived from MPEG data.

* * * * *